US007045941B2

(12) United States Patent
Mashimo et al.

(10) Patent No.: US 7,045,941 B2
(45) Date of Patent: May 16, 2006

(54) COLOR CATHODE RAY TUBE

(75) Inventors: Takuya Mashimo, Kumagaya (JP); Tohru Takahashi, Osato-gun (JP); Hiroyuki Oda, Fukaya (JP); Takeshi Nakayama, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 66 days.

(21) Appl. No.: 10/766,868

(22) Filed: Jan. 30, 2004

(65) Prior Publication Data

US 2004/0183424 A1 Sep. 23, 2004

Related U.S. Application Data

(63) Continuation of application No. PCT/JP03/06674, filed on May 28, 2003.

(30) Foreign Application Priority Data

May 30, 2002 (JP) ..... 2002-156957

(51) Int. Cl.
*H01J 29/80* (2006.01)

(52) U.S. Cl. ..... 313/402; 313/407

(58) Field of Classification Search ..... 313/402
See application file for complete search history.

(56) References Cited

U.S. PATENT DOCUMENTS

| | | | | |
|---|---|---|---|---|
| 4,996,458 | A * | 2/1991 | Hattori et al. | 313/402 |
| 5,079,477 | A * | 1/1992 | Yamamoto | 313/403 |
| 5,180,322 | A * | 1/1993 | Yamamoto et al. | 445/37 |
| 5,635,320 | A * | 6/1997 | Ohtake et al. | 430/23 |
| 5,686,784 | A * | 11/1997 | Thoms et al. | 313/402 |
| 6,577,047 | B1 * | 6/2003 | Ohmae et al. | 313/402 |
| 6,803,713 | B1 * | 10/2004 | Takahashi et al. | 313/402 |
| 6,894,444 | B1 * | 5/2005 | Nakayama et al. | 315/366 |
| 2004/0256970 | A1 * | 12/2004 | Takahashi et al. | 313/402 |

FOREIGN PATENT DOCUMENTS

| | | |
|---|---|---|
| JP | 60-243945 | 12/1985 |
| JP | 2-78134 | 3/1990 |
| JP | 2-123645 | 5/1990 |
| JP | 2-143759 | 12/1990 |
| JP | 5-41179 | 2/1993 |
| JP | 5-89773 | 4/1993 |
| JP | 2743406 | 2/1998 |
| JP | 11-185650 | 7/1999 |
| JP | 2001-297708 | 10/2001 |
| JP | 2002-197989 | 7/2002 |
| JP | 2002-304953 | 10/2002 |
| KR | 1999-0063254 | 7/1999 |

* cited by examiner

*Primary Examiner*—Joseph Williams
*Assistant Examiner*—Dalei Dong
(74) *Attorney, Agent, or Firm*—Oblon, Spivak, McClelland, Maier & Neustadt, P.C.

(57) ABSTRACT

A shadow mask has a main mask and an auxiliary mask overlapped on the main mask. Electron beam passage apertures formed in the main mask and the auxiliary mask are arranged at given pitches in the direction of a major axis. Each electron beam passage aperture of the auxiliary mask is a communicating hole, which is formed of a smaller hole in that surface of the auxiliary mask which is in contact with the main mask and a larger hole opening in the opposite surface of the auxiliary mask. The smaller and larger holes of each electron beam passage aperture of the auxiliary mask have their respective central axes extending coaxially with each other and substantially at right angles to the surface of the auxiliary mask in the direction of the major axis.

8 Claims, 4 Drawing Sheets

| | Da[mm] | Db[mm] | Da/Db | Weld strength |
|---|---|---|---|---|
| Auxiliary mask (a) | 0.20 | 0.30 | 0.67 | × |
| Auxiliary mask (b) | 0.18 | 0.23 | 0.78 | ○ |
| Auxiliary mask (c) | 0.21 | 0.26 | 0.81 | ◎ |
FIG. 8
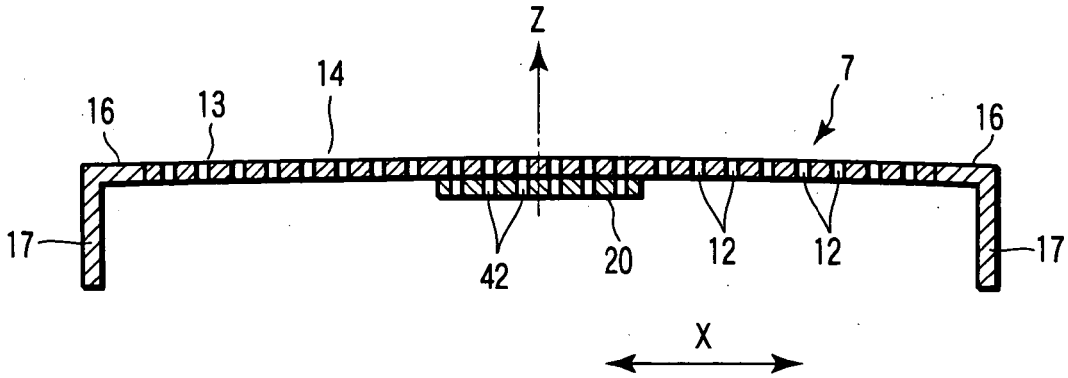
FIG. 9
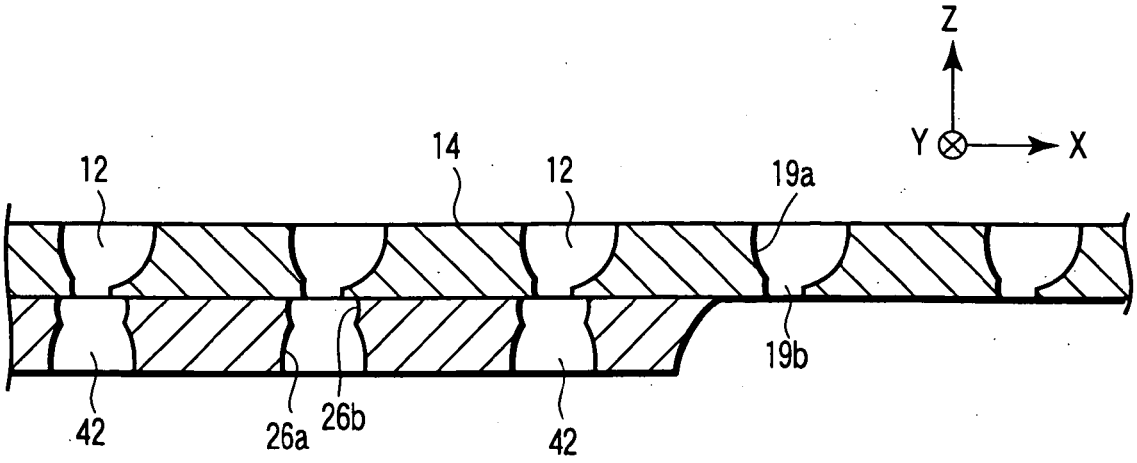
FIG. 10

COLOR CATHODE RAY TUBE

CROSS-REFERENCE TO RELATED APPLICATIONS

This is a Continuation Application of PCT application No. PCT/JP03/06674, filed May 28, 2003, which was not published under PCT Article 21(2) in English.

This application is based upon and claims the benefit of priority from the prior Japanese Patent Application No. 2002-156957, filed May 30, 2002, the entire contents of which are incorporated herein by reference.

BACKGROUND OF THE INVENTION

1. Field of the Invention

This invention relates to a color cathode ray tube provided with a shadow mask.

2. Description of the Related Art

In general, a color cathode ray tube comprises an envelope and a substantially rectangular shadow mask. The envelope includes a panel that has a phosphor screen on its inner surface. The shadow mask is opposed to the phosphor screen in the envelope. A number of apertures are formed as electron beam passage apertures in a given array in a effective surface of the shadow mask that faces the phosphor screen. The shadow mask has the function of screening three electron beams that are emitted from an electron gun through the apertures so that the electron beams are incident upon three-color phosphor layers that constitute the phosphor screen.

Recently, flat tubes have become prevalent color cathode ray tubes. In order to reduce daylight reflection and image distortion and so improve visibility, a flat tube is designed so that the outer surface of its panel is substantially flat, having a curvature radius of 10,000 mm or more. Conventionally, the effective surface of the shadow mask that faces the phosphor screen is shaped corresponding to the shape of the inner surface of the panel. Therefore, the shadow mask of the flat tube is substantially flat, having a curvature smaller than that of a conventional color cathode ray tube.

However, use of a shadow mask with a small curvature involves the following problems.

Usually, the shadow mask is formed of a metal sheet with a thickness of about 0.2 mm. The shadow mask for a large screen that is formed of a thin sheet of this type is deformed by its own weight or external force, and cannot easily maintain its curved mask surface if the curvature of the effective surface is small. Thus, if the curvature of the effective surface is reduced, the retention of the curved mask surface (hereinafter referred to as curved mask surface strength) drops. The curved mask surface strength drops most significantly near the center of the effective surface or the picture center, in particular.

If the curved mask surface strength is low, the effective surface of the shadow mask is inevitably deformed by a very small external force during manufacture or transportation. In this case, the distance between the inner surface of the panel and the electron beam passage apertures of the shadow mask varies, so that the electron beams emitted from the electron gun cause a color drift, failing to land on predetermined phosphor layers.

Although the lowering of the curved mask surface strength never renders the shadow mask deformed, it inevitably causes the effective surface of the mask to be easily resonated by vibration such as sound when the mask is incorporated in a TV set. Thus, unwanted gradation is bound to appear on the picture.

Increasing the thickness of the shadow mask is the easiest method to prevent the curved mask surface strength from dropping. If the shadow mask thickness is increased, however, etching control for the manufacture of the shadow mask becomes difficult, and the variation of the diameter of the electron beam passage apertures worsens. In consequence, the yield of manufacture of the shadow mask and the color cathode ray tube and the picture quality level are lowered.

As means for solving these problems, therefore, shadow mask structures are described in Jpn. Pat. Appln. KOKOKU Publication No. 6-50610, Jpn. Pat. Appln. KOKAI Publication No. 2-123645 (Jpn. Pat. Appln. Publication No. 2743406), etc. They are constructed in a manner such that a plurality of shadow mask plates in the same shape, having electron beam passage apertures each, are superposed on one another and welded in a plurality of positions.

In the shadow mask constructed in this manner, a plurality of shadow mask plates are superposed closely on one another, whereby the plate thickness is simulatively increased to enhance the curved mask surface strength. If the degree of fixation of the shadow mask plates (hereinafter referred to as the lamination strength) is low, therefore, the degree of their adhesion lowers, so that the curved mask surface strength cannot be enhanced with ease.

If the lamination strength is low, moreover, the shadow mask plates are inevitably dislocated from one another when they are subjected to external force during manufacture or transportation. Thereupon, the electron beam passage apertures that are formed in the individual shadow mask plates are dislocated, so that the apertures, the electron beam passage apertures, are narrowed, and sometimes may be closed. In this case, the electron beams that pass through the apertures are reduced in number, so that light emission from the phosphor screen drops. In consequence, the luminance of images is partially lowered.

BRIEF SUMMARY OF THE INVENTION

This invention has been made in consideration of these circumstances, and its object is to provide a color cathode ray tube, which is furnished with a shadow mask having adequate curved mask surface strength and enjoys a satisfactory image quality level.

In order to achieve the above object, a color cathode ray tube according to an aspect of this invention comprises: a panel having a phosphor screen on an inner surface thereof; an electron gun which emits electron beams toward the phosphor screen; and a substantially rectangular shadow mask located opposite the phosphor screen inside the panel and having a major axis and a minor axis extending at right angles to each other and to a tube axis. The shadow mask includes a main mask opposed substantially to the whole surface of the phosphor screen and having a substantially rectangular effective portion formed with a number of electron beam passage apertures and a belt-shaped auxiliary mask fixed to a region containing the minor axis of the effective portion of the main mask, having a number of electron beam passage apertures corresponding individually to the electron beam passage apertures of the main mask, and elongated along the minor axis. Each of the electron beam passage apertures of the auxiliary mask is a communicating hole formed of a substantially rectangular smaller hole opening in that surface of the auxiliary mask which is in contact with the main mask and a substantially rectangular larger hole opening in the opposite surface of the auxiliary mask. The smaller and larger holes of each electron beam passage aperture of the auxiliary mask individually have central axes extending coaxially with each other and substantially at right angles to the surface of the auxiliary mask in the direction of the major axis.

In a color cathode ray tube according to another aspect, the shadow mask includes a main mask opposed substantially to the whole surface of the phosphor screen and having a substantially rectangular effective portion formed with a large number of electron beam passage apertures and a belt-shaped auxiliary mask fixed to a region containing the minor axis of the effective portion of the main mask, having a large number of electron beam passage apertures corresponding individually to the electron beam passage apertures of the main mask, and elongated along the minor axis.

Each of the electron beam passage apertures of the auxiliary mask is a communicating hole formed of a substantially rectangular smaller hole opening in that surface of the auxiliary mask which is in contact with the main mask and a substantially rectangular larger hole opening in the opposite surface of the auxiliary mask. The electron beam passage aperture of the auxiliary mask has relationships:

$$0.7 \leqq Da/Db \text{ and } Da<Db,$$

where Da and Db are the diameter of the smaller hole in the direction of the major axis and the diameter of the larger hole in the direction of the major axis, respectively. The smaller and larger holes of each electron beam passage aperture of the auxiliary mask individually have central axes extending coaxially with each other and substantially at right angles to the surface of the auxiliary mask in the direction of the major axis.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

FIG. 8 is a diagram showing the relation between the weld strength of the main and auxiliary masks and the aperture diameter of each auxiliary mask;

FIG. 9 is a sectional view showing a shadow mask of a color cathode ray tube according to an alternative embodiment of this invention; and FIG. 10 is an enlarged sectional view showing a part of the shadow mask of the alternative embodiment.

DETAILED DESCRIPTION OF THE INVENTION

Color cathode ray tubes according to embodiments of this invention will now be described in detail with reference to the drawings.

Figure 1:
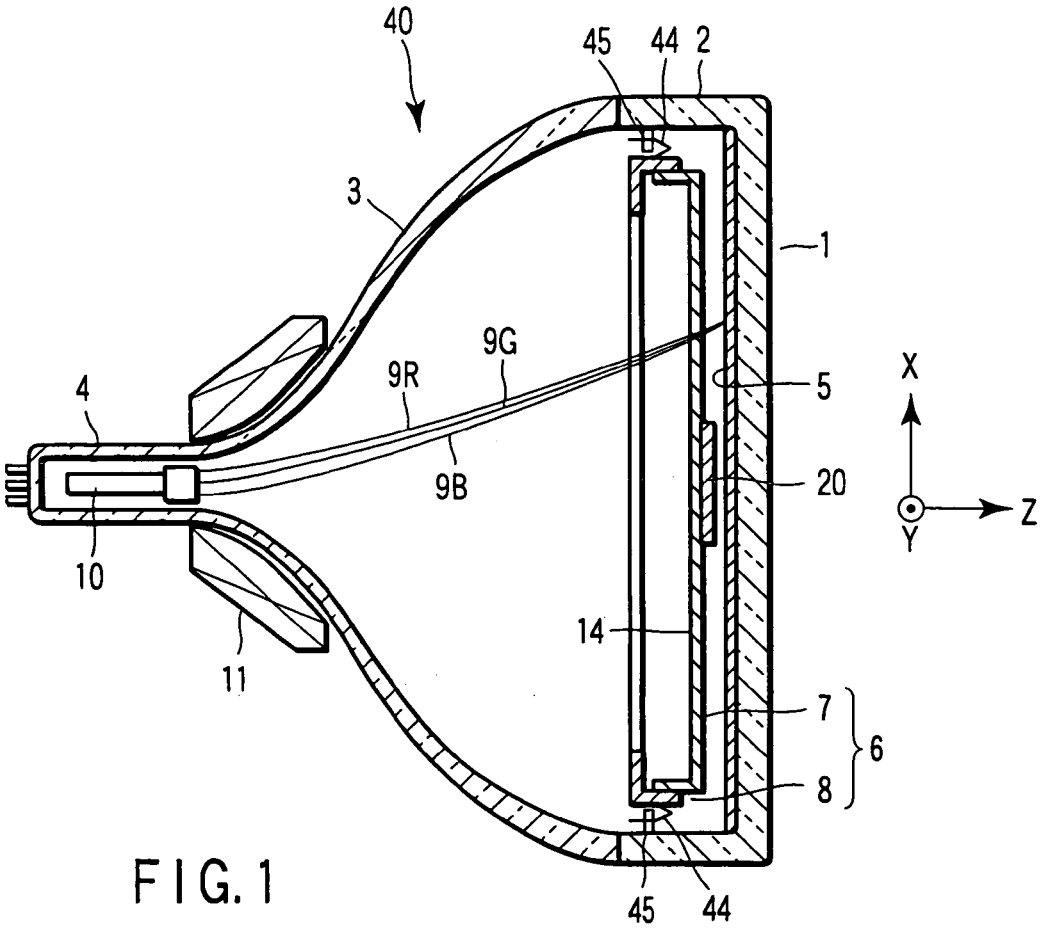
FIG. 1 is a sectional view containing the major axis of a color cathode ray tube according to an embodiment of this invention.
Figure 2:
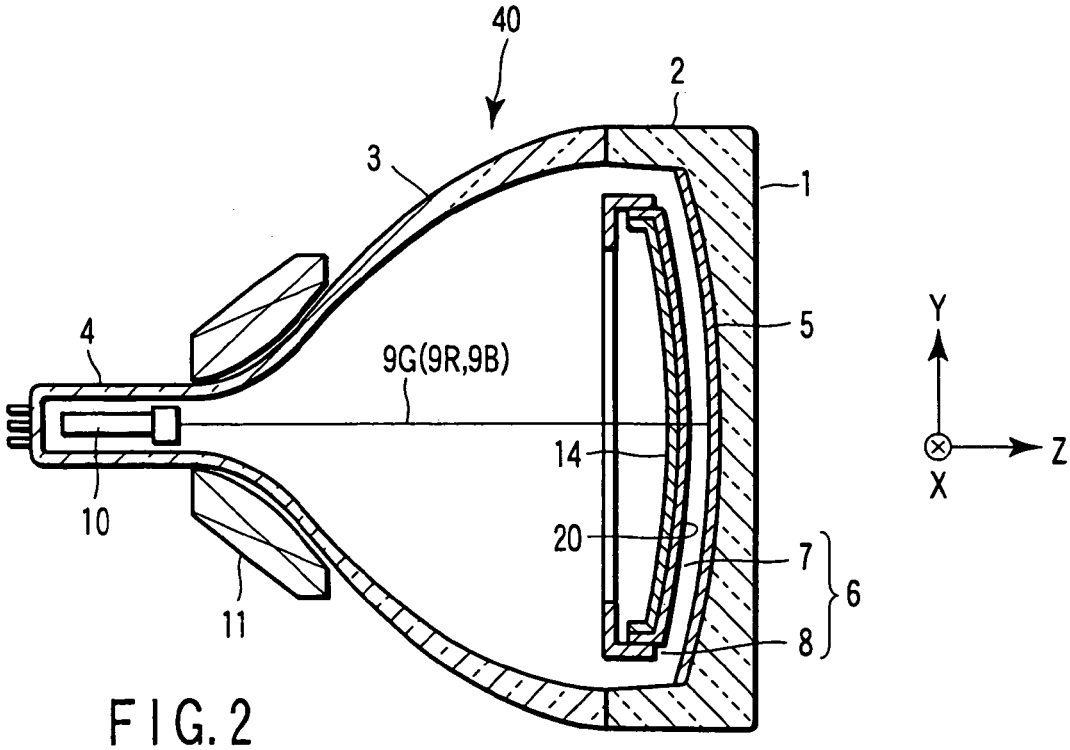
FIG. 2 is a sectional view containing the minor axis of the color cathode ray tube.
Figure 3:
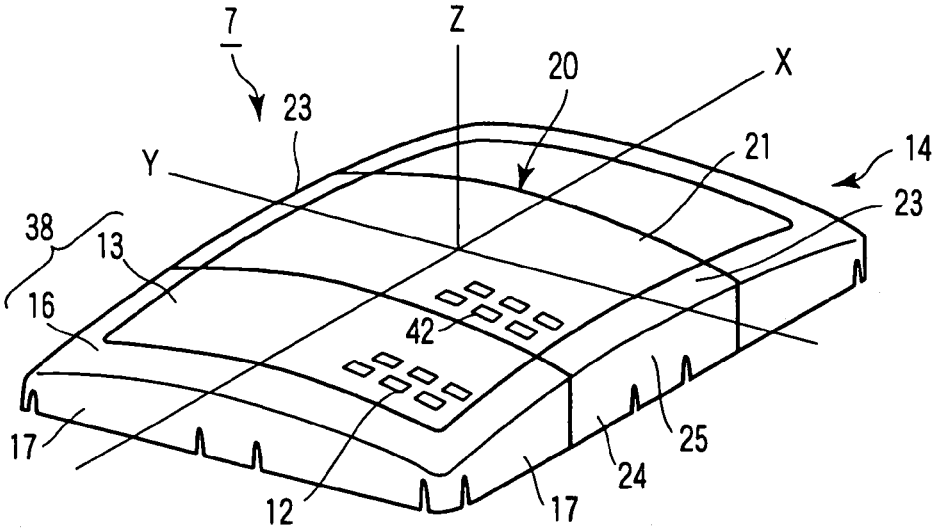
FIG. 3 is a perspective view showing a shadow mask in the color cathode ray tube.
Figure 4:
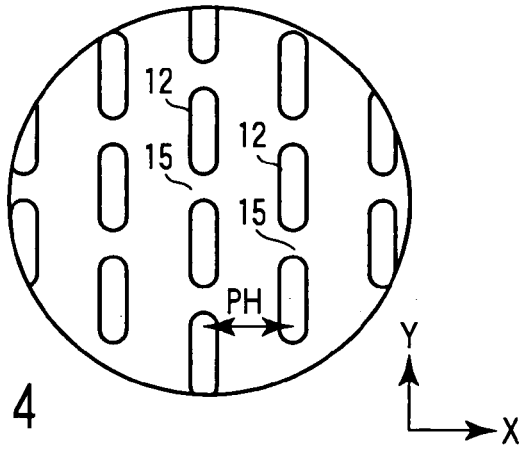
FIG. 4 is a plan view showing electron beam passage apertures of the shadow mask.
Figure 5:
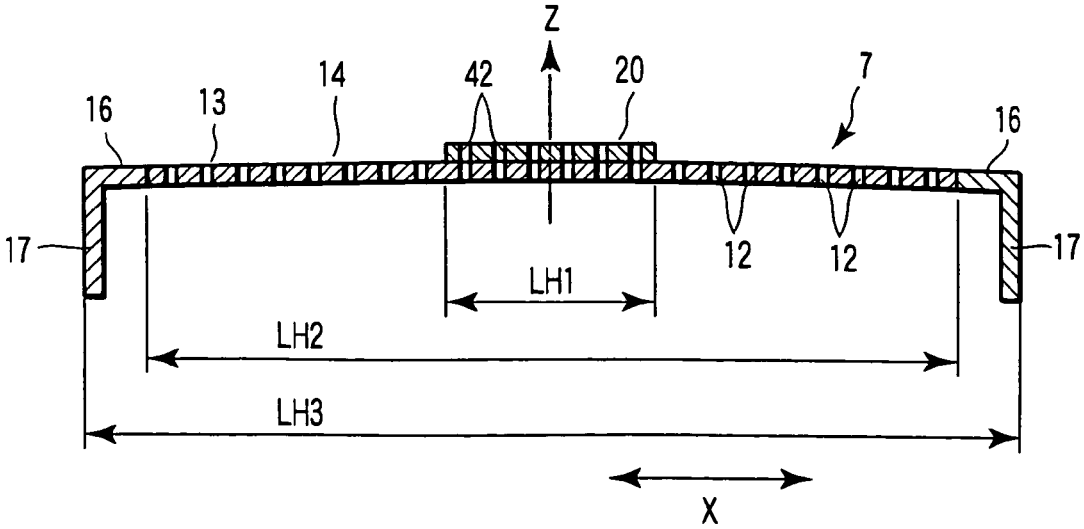
FIG. 5 is a sectional view of the shadow mask shown in FIG. 3 taken along its major axis.
Figure 6:
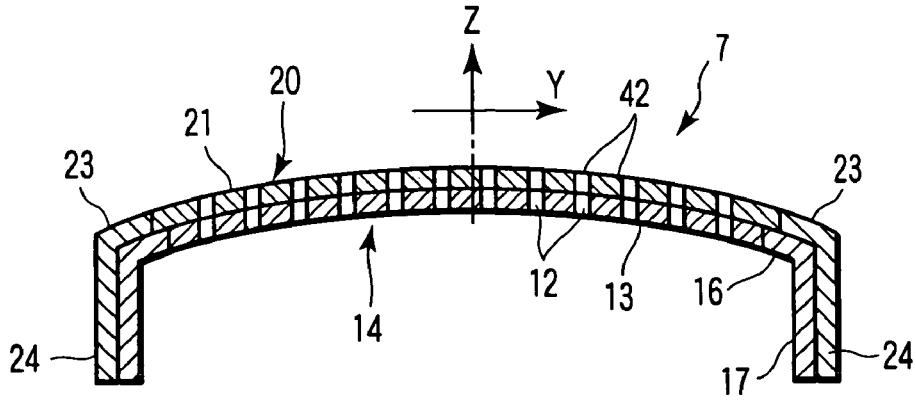
FIG. 6 is a sectional view of the shadow mask shown in FIG. 3 taken along its minor axis.

As shown in FIGS. 1 and 2, a color cathode ray tube comprises an envelope 40 that is formed of glass. The envelope 40 includes a rectangular panel 1 having a skirt portion 2 on its peripheral edge portion, a funnel 3 bonded to the skirt portion 2 of the panel 1, and a neck 4 extending from a small-diameter portion of the funnel 3. A phosphor screen 5 is formed on the inner surface of the panel 1. The envelope 40 has a tube axis Z that passes through the respective centers of the panel 1 and the neck 4, a major axis (horizontal axis) X that extends perpendicularly to the tube axis, and a minor axis (vertical axis) Y that extends perpendicularly to the tube axis and the major axis.

In the case of a 32-inch wide-type color cathode ray tube having a picture aspect ratio of 16:9 and a picture effective diameter of 76 cm, for example, the outer surface of the panel 1 is substantially flat, having a curvature radius of 100,000 mm. Further, the inner surface of the panel 1 is cylindrical, having a curvature radius of about 7,000 mm on and along the X-axis and a curvature radius of about 1,500 mm on and along the Y-axis.

A shadow mask structure 6 as a color selecting electrode is located in the envelope and opposed to the phosphor screen 5. The shadow mask structure 6 has a shadow mask 7 and a mask frame 8 in the form of a rectangular frame having an L-shaped cross section. A large number of apertures as electron beam passage apertures are formed in the shadow mask 7. The peripheral portion of the shadow mask 7 is fixed to the mask frame 8. The shadow mask structure 6 is supported on the inside of the panel 1 with elastic supports 44 on the sidewall of the mask frame 8 anchored individually to stud pins 45 that are fixed to the skirt portion 2 of the panel 1. The electron beam passage apertures in the shadow mask 7 are formed having a rectangular or circular opening shape depending on the way of use.

Located in the neck 4 is an electron gun 10 that emits three electron beams 9R, 9G and 9B that are arranged in line on the major axis X. In the color cathode ray tube described above, the electron beams 9R, 9G and 9B emitted from the electron gun 10 are deflected by a deflection yoke 11 mounted on the outside of the funnel 3. The electron beams scan the phosphor screen 5 horizontally and vertically with the aid of the shadow mask structure 6. Thus, phosphor layers of the phosphor screen 5 are excited to display an image.

The following is a detailed description of the configuration of the shadow mask 7. As shown in FIGS. 3 to 6, the shadow mask 7 comprises a main mask 14 and an auxiliary mask 20 that is fixed to a part of the main mask in an overlapping manner, thus partially having a dual structure.

The main mask 14 is provided integrally with a substantially rectangular principal mask surface 38 and a skirt portion 17. The principal mask surface 38 is opposed to the inner surface of the panel 1 and has a curved surface in a given shape. The skirt portion 17 extends in the direction of the tube axis Z from the peripheral edge of the principal mask surface toward the electron gun. The principal mask surface 38 has a rectangular effective portion 13 and a noneffective portion 16 in the form of a substantially rectangular frame. The effective portion 13 has a number of apertures 12 that function as electron beam passage apertures. The noneffective portion 16 is situated around the effective portion 13 and has no apertures.

Each aperture 12 of the main mask 14 has a substantially rectangular shape, having its width in the direction of the major axis X of the effective portion 13. The apertures 12 are arranged so that a large number of columns of apertures, which individually extend straight in the direction of the minor axis Y of the effective portion, are disposed at array pitches PH of about 0.4 to 0.6 mm in the direction of the major axis X. In each aperture column, a plurality of apertures 12 are arranged substantially in a straight line in the direction of the minor axis Y with bridges 15 between them.

Figure 7:
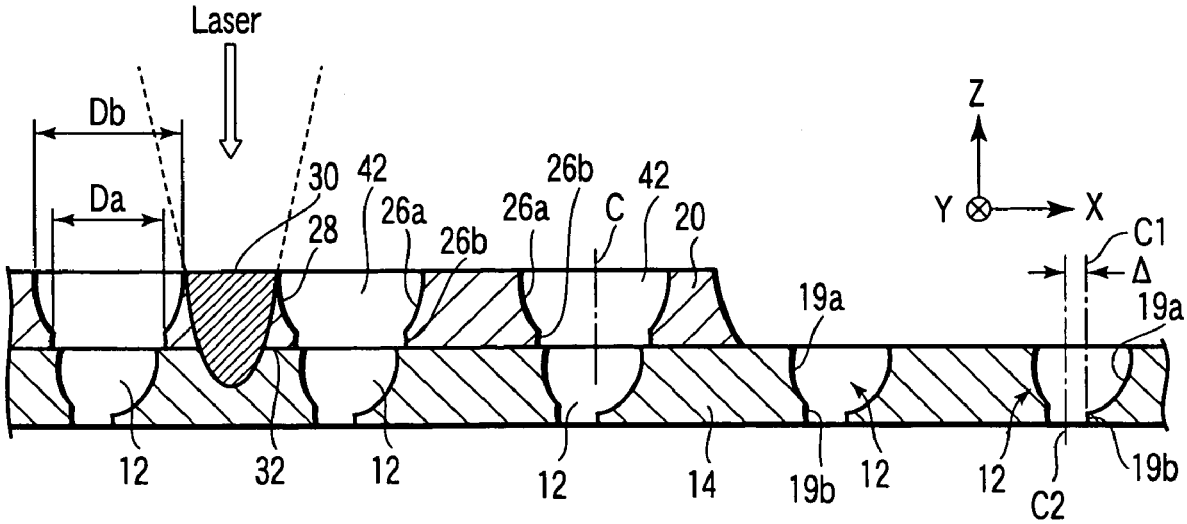
FIG. 7 is an enlarged sectional view showing a main mask and an auxiliary mask of the shadow mask.

As shown in FIG. 7, each aperture 12 is a communicating hole defined by a substantially rectangular larger hole 19*a* and a substantially rectangular smaller hole 19*b* that communicate with each other. The larger hole opens in that surface of the main mask 14 on the phosphor screen side. The smaller hole opens in that surface of the main mask on the electron gun side. In each of the apertures that, among the other apertures 12, are situated on the peripheral side of the effective portion 13, a center C1 of the larger hole 19*a* is deviated relatively from a center C2 of the smaller hole 19*b* by an offset Δ on the peripheral side of the effective portion. The offset Δ becomes greater for the apertures that are situated nearer to the peripheral side of the effective portion 13. The electron beams are obliquely incident upon the apertures 12 at the peripheral portion of the main mask 14. Therefore, each electron beam is restrained from running against and being reflected by the inner surface of each aperture 12 and from producing useless light emission on the picture plane after having passed through the smaller hole 19*b*. The larger hole 19*a* is offset with respect to the smaller hole 19*b* in both the directions of the minor axis Y and the major axis X of the main mask 14.

As shown in FIGS. 3 to 7, the auxiliary mask 20 is in the form of an elongated belt, which is fixedly overlaid on that region of the outer surface of the main mask 14 or of the surface on the side of the phosphor screen 5 which contains the minor axis Y of the effective portion 13. The auxiliary mask 20 is located so that its longitudinal direction is coincident with the minor axis Y of the main mask 14. The dual-structure part of the shadow mask to which the auxiliary mask 20 is fixed will be referred to as a superposed portion, and the other parts as non-superposed portions.

A width L of the auxiliary mask 20 in the direction of the major axis X is shorter than a length L of the effective portion 13 of the main mask 14 in the major-axis direction, and its length in the direction of the minor axis Y is substantially equal to the length of the main mask 14 in the same direction. The auxiliary mask 20 is provided integrally with an effective portion 21, noneffective portions 23 situated individually at the longitudinally opposite end portions of the auxiliary mask outside the effective portion 21, and a pair of skirt portions 24 that extend individually from the noneffective portions 23 toward the opposite ends. The effective portion 21 is formed having a number of apertures 42 as electron beam passage apertures corresponding individually to the apertures 12 of the main mask 14.

The auxiliary mask 20 is fixed to the main mask 14 in a manner such that its effective portion 21, noneffective portions 23, and skirt portions 24 overlap the effective portion 13, noneffective portion 16, and skirt portion 17, respectively, of the main mask. Thus, the whole area on the minor axis Y of the main mask 14 has a dual structure.

Each aperture 42 in the effective portion 21 is a communicating hole formed of a substantially rectangular larger hole 26*a* and a substantially rectangular smaller hole 26*b* that communicate with each other. The larger hole opens in that surface of the auxiliary mask 20 on the phosphor screen side. The smaller hole opens in the surface on the electron gun side, that is, the surface on the side of the main mask 14. Thus, the auxiliary mask 20 is fixed to the main mask 14 in a manner such that the smaller hole 26*b* of each aperture 42 faces the main mask 14. The apertures 42 of the auxiliary mask 20, like the apertures 12 of the main mask 14, form a plurality of aperture columns that extend in the direction of the minor axis Y. These aperture columns are disposed at pitches of about 0.4 to 0.6 mm in the direction of the major axis X. Thus, the apertures 42 are arranged individually in alignment with the apertures 12 of the main mask 14.

The auxiliary mask 20 is fixed to the main mask 14 in a manner such that a plurality of parts of the effective portion 21 and noneffective portions 23 are laser-welded to the main mask 14. In welding the skirt portion 2, a laser beam is applied from the side of the auxiliary mask 20. In doing this, the laser beam is applied from the side of the auxiliary mask 20 to a region 28 between the aperture columns that extend straight in the direction of the minor axis Y, as shown in FIG. 7, whereby the laser welding is effected. Thus, that region of the auxiliary mask 20 which is situated between the apertures 42 that adjoin one another in the direction of the major axis X is welded to the main mask 14.

The laser welding is based on the following principle. First, a laser beam is applied to a laser irradiation surface 30 to generate heat energy thereon. Then, pressure waves that are produced in the direction of the laser irradiation cause a heat flow, thereby moving the heat energy to a welded surface 32 between the main mask 14 and the auxiliary mask 20. These two phenomena cause the temperature of the welding surface 32 to increase, so that the surfaces 32 fuse together.

In order to enhance the weld strength of the main mask 14 and the auxiliary mask 20, therefore, the generated heat energy should preferably be increased, and the heat flow should be given high directivity toward the welded surfaces 32. Thus, by reducing a larger hole diameter Db of each larger hole 26*a* in the laser irradiation surface 30 along the major axis X, the laser irradiation area can be widened, and the heat energy can be increased. In consequence, the weld strength can be enhanced.

Further, the heat flow that is parallel to the mask surface can be restrained by enlarging a smaller hole diameter Da of the smaller hole 26*b* in each welded surface 32 along the major axis X. Thus, the heat flow can be given positive directivity toward the welded surfaces 32, so that the weld strength can be enhanced.

Thereupon, the relationship between the weld strength and the shape of the apertures of the auxiliary mask 20 was tested. In this test, auxiliary masks of three types such that the spaces between the aperture columns are fixed and the apertures 42 are different in aperture diameter were prepared, and the weld strength for the laser welding of these auxiliary masks to the main mask was examined. The weld strength was evaluated by the presence of nuggets at welding points and their stability when the auxiliary masks fixed to the main mask by the laser welding were stripped from the main mask. FIG. 8 shows the result of the test.

As shown in this drawing, satisfactory weld strength was obtained for auxiliary masks (b) and (c) in which the smaller hole diameter Da of each aperture 42 in the auxiliary masks along the major axis X and the larger hole diameter Db along the major axis have the following relationships:

$$0.7 \leqq Da/Db, \text{ and } Da<Db.$$

According to the present embodiment, as shown in FIG. 7, the larger hole 26*a* and the smaller hole 26*b* that constitute each aperture 42 of the auxiliary mask 20 are formed so as to fulfill the above relations.

Based on the principle of the laser welding described above, the laser irradiation surface 30 and the welded surfaces 32 must be situated on the axis in the laser irradiation direction. If the laser irradiation direction is perpendicular to the laser irradiation surface 30, the laser energy for the unit area is maximized. Preferably, therefore, the laser beam is applied to the mask surface at right angles to it. Accordingly, it is best that the laser irradiation surface 30 and the welded surfaces 32 be situated on the same axis in the direction perpendicular to the mask surface.

Thus, it is best for the apertures 42 of the auxiliary mask 20 to open at right angles to the mask surface in the direction of the major axis X. In this case, the laser welding can be carried out most steadily. According to the present embodiment, therefore, the larger hole 26*a* and the smaller hole 26*b* that constitute each aperture 42 of the auxiliary mask 20 are formed in a manner such that their respective central axes C extend at right angles to the mask surface or the surface of the auxiliary mask and substantially coaxially with each other, as shown in FIG. 7.

According to the color cathode ray tube constructed in this manner, the auxiliary mask 20 is located overlapping the main mask 14, so that the central portion of the shadow mask 7 that is most liable to deformation can be restrained from being deformed. In consequence, the curved mask surface strength can be enhanced. Each aperture 42 of the auxiliary mask 20 is formed so that the smaller hole diameter Da along the major axis X and the larger hole diameter Db along the major axis X fulfill the relationships $0.7 \leqq Da/Db$ and $Da<Db$. Thus, the laser irradiation area can be widened to increase the laser energy, in reducing the larger hole diameter Db along the major axis X of the auxiliary mask 20 and fixing the auxiliary mask to the main mask by laser welding, especially in laser-welding the region between the apertures that adjoin one another in the major-axis direction of the mask effective portion from the larger hole surface side of the auxiliary mask. Further, the smaller hole diameter Da along the major axis X of the auxiliary mask 20 can be increased, so that diffusion of energy in a direction parallel to the mask surface can be restrained, and weld strength can be enhanced.

Since the electron beam passage apertures of the auxiliary mask open at right angles to the mask surface in the direction of the major axis, the laser irradiation surface of the auxiliary mask and the welded surfaces on which the main mask and the auxiliary mask are in contact with each other are vertically coincident with the mask surface. Therefore, the laser welding can be carried out with the highest efficiency, so that the weld strength of the main mask and the auxiliary mask and the lamination strength can be enhanced. Accordingly, dislocation between the auxiliary mask and the main mask is prevented, and the strength of the shadow mask is properly increased by means of the auxiliary mask, whereupon desired mask strength can be obtained. Thus, deformation of the shadow mask and deterioration of images attributable to vibration can be prevented, so that a color cathode ray tube with an improved image quality level can be obtained.

This invention is not limited to the embodiment described above, and various modifications may be effected therein without departing from the scope of the invention. In the embodiment described above, for example, the auxiliary mask 20 is located on the phosphor screen side of the main mask 14. Alternatively, however, the auxiliary mask 20 may be located on the electron gun side of the main mask 14, as shown in FIGS. 9 and 10. In this case, the auxiliary mask 20 is fixed to the main mask 14 with the smaller hole 26*b* of each aperture 42 opposed to the main mask 14. As in the case of the foregoing embodiment, the auxiliary mask 20 is welded to the main mask 14 in a plurality of positions by applying the laser beam form the auxiliary mask side.

The same functions and effects as aforesaid can be also obtained with use of the shadow mask constructed in this manner. Further, a plurality of auxiliary masks may be provided without being limited to one in number.

What is claimed is:

1. A color cathode ray tube comprising:

a panel having a phosphor screen on an inner surface thereof;

an electron gun which emits electron beams toward the phosphor screen; and a substantially rectangular shadow mask located opposite the phosphor screen inside the panel and having a major axis and a minor axis extending at right angles to each other and to a tube axis, the shadow mask including a main mask opposed substantially to the whole surface of the phosphor screen and having a substantially rectangular effective portion formed with a plurality of electron beam passage apertures and a belt-shaped auxiliary mask fixed to a region containing the minor axis of the effective portion of the main mask, the auxiliary mask having a width in the direction of the major axis smaller than a length of the effective portion of the main mask in the direction of the major axis, and having a plurality of electron beam passage apertures corresponding individually to the electron beam passage apertures of the main mask, and elongated along the minor axis, each of the electron beam passage apertures of the auxiliary mask being a communicating hole formed of a substantially rectangular smaller hole opening in that surface of the auxiliary mask which is in contact with the main mask and a substantially rectangular larger hole opening in the opposite surface of the auxiliary mask, and the smaller and larger holes of each electron beam passage aperture of the auxiliary mask individually having central axes extending coaxially with each other and substantially at right angles to the surface of the auxiliary mask in the direction of the major axis.

2. A color cathode ray tube according to claim 1, wherein the electron beam passage apertures of the main mask and the auxiliary mask are arranged at pitches of about 0.4 mm to 0.6 mm in the direction of the major axis.

3. A color cathode ray tube according to claim 2, wherein that region of the auxiliary mask which is situated between the electron beam passage apertures adjoining one another in the direction of the major axis is welded to the main mask.

4. A color cathode ray tube according to claim 1, wherein that region of the auxiliary mask which is situated between the electron beam passage apertures adjoining one another in the direction of the major axis is welded to the main mask.

5. A color cathode ray tube comprising:

a panel having a phosphor screen on an inner surface thereof;

an electron gun which emits electron beams toward the phosphor screen; and a substantially rectangular shadow mask located opposite the phosphor screen inside the panel and having a major axis and a minor axis extending at right angles to each other and to a tube axis, the shadow mask including a main mask opposed substantially to the whole surface of the phosphor screen and having a substantially rectangular effective portion formed with a plurality of electron beam passage apertures and a belt-shaped auxiliary mask fixed to a region containing the minor axis of the effective portion of the main mask, the auxiliary mask having a width in the direction of the major axis smaller than a length of the effective portion of the main mask in the direction of the major axis, and having a plurality of electron beam passage apertures corresponding individually to the electron beam passage apertures of the main mask, and elongated along the minor axis, each of the electron beam passage apertures of the auxiliary mask being a communicating hole formed of a substantially rectangular smaller hole opening in that surface of the auxiliary mask which is in contact with the main mask and a substantially rectangular larger hole opening in the opposite surface of the auxiliary mask, the electron beam passage aperture of the auxiliary mask having relationships:

$$07 \leqq Da/Db \text{ and } Da < Db,$$

where Da and Db are the diameter of the smaller hole in the direction of the major axis and the diameter of the larger hole in the direction of the major axis, respectively, and the smaller and larger holes of each electron beam passage aperture of the auxiliary mask individually having central axes extending coaxially with each other and substantially at right angles to the surface of the auxiliary mask in the direction of the major axis.

6. A color cathode ray tube according to claim 5, wherein the electron beam passage apertures of the main mask and the auxiliary mask are arranged at pitches of about 0.4 mm to 0.6 mm in the direction of the major axis.

7. A color cathode ray tube according to claim 6, wherein that region of the auxiliary mask which is situated between the electron beam passage apertures adjoining one another in the direction of the major axis is welded to the main mask.

8. A color cathode ray tube according to claim 5, wherein that region of the auxiliary mask which is situated between the electron beam passage apertures adjoining one another in the direction of the major axis is welded to the main mask.

* * * * *